US005259807A

United States Patent [19]

Crow

[11] Patent Number: 5,259,807

[45] Date of Patent: Nov. 9, 1993

[54] MASCOT CHEER SIMULATOR

[75] Inventor: Rodger D. Crow, Sadler, Tex.

[73] Assignee: Roger D. Crow, Sherman, Tex.

[21] Appl. No.: 782,819

[22] Filed: Oct. 25, 1991

[51] Int. Cl.[5] ..... A63H 5/00; A63H 5/04; A63H 33/30; A63H 29/22

[52] U.S. Cl. ..... 446/397; 446/406; 446/473; 446/484; 365/45

[58] Field of Search ..... 446/397, 401, 404, 405, 446/406, 408, 473, 484, 485; 367/139; 365/45

[56] References Cited

U.S. PATENT DOCUMENTS

| | | | |
|---|---|---|---|
| 3,939,579 | 2/1976 | Andrews et al. | 434/316 |
| 4,105,992 | 8/1978 | Luciano | 367/139 |
| 4,175,353 | 11/1979 | Pickett | 446/406 |
| 4,314,423 | 2/1982 | Lipsitz et al. | 446/14 X |
| 4,348,191 | 9/1982 | Lipsitz et al. | 446/297 X |
| 4,651,613 | 3/1987 | Harrison | 446/297 X |
| 4,808,143 | 2/1909 | Kuo | 446/406 |
| 4,820,233 | 4/1989 | Weiner | 446/397 X |
| 4,836,075 | 6/1989 | Armstrong | 446/397 X |
| 4,896,305 | 1/1990 | Gimbal | 367/139 |
| 5,087,043 | 2/1992 | Billings et al. | 434/327 X |
| 5,145,447 | 9/1992 | Goldfarb | 446/484 X |

*Primary Examiner*—Robert A. Hafer
*Assistant Examiner*—D. Neal Muir
*Attorney, Agent, or Firm*—Robert C. Curfiss

[57] ABSTRACT

A battery operated, hand held, clamor making device is provided in this invention, for use by booster fans of a sports team to express identifiable outcry and clamorous support for their team. The device is trigger switch operated. A read-only-memory circuit is digitally preprogrammed with digital messages depicting recognizable, characteristic mascot sounds to match a given team mascot. The read-only-memory circuit is coupled with a digital-to-analog converter, an amplifier, a speaker, a power supply, and a trigger switch, miniaturized and packaged in a light weight, hand held apparatus, which, upon actuation, provides reading, amplification and output of recognizable, characteristic sounds of a particular mascot.

2 Claims, 2 Drawing Sheets

FIG. 4
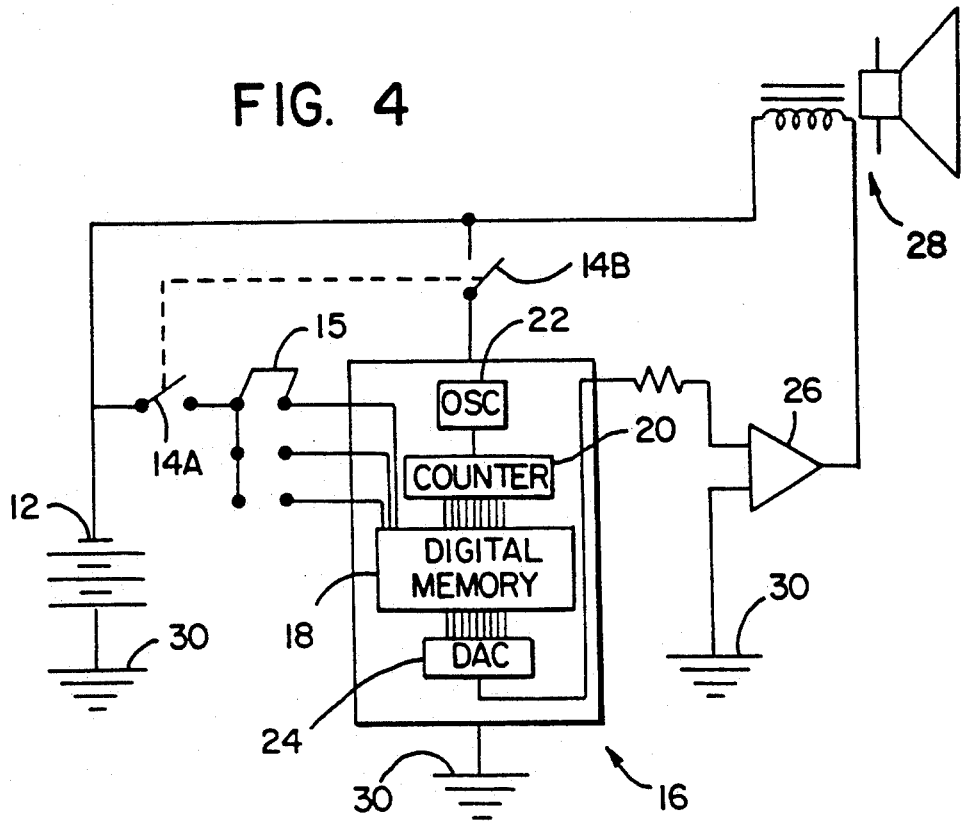
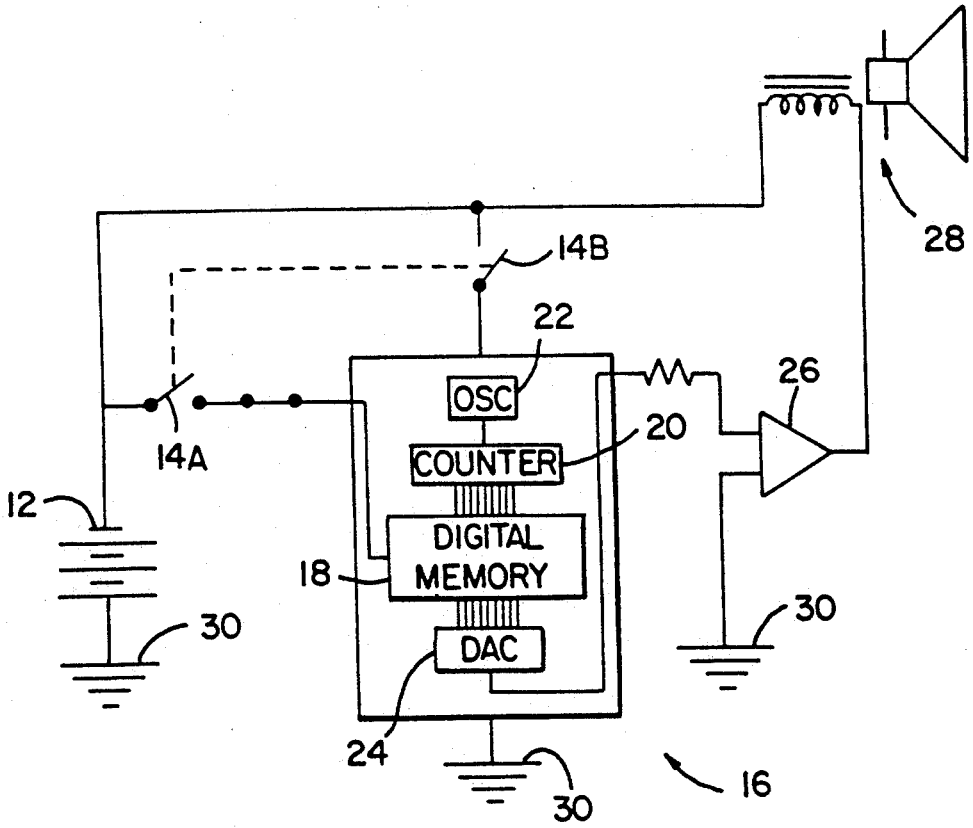
FIG. 5

MASCOT CHEER SIMULATOR

TECHNICAL FIELD OF THE INVENTION

The present invention relates to the field of noise making devices as used by sports fans and booster clubs in support for their teams; and more particularly to a battery operated, hand held apparatus for creating a great outcry of simulated mascot sounds.

BACKGROUND OF THE INVENTION

Sports teams expect clamorous support from their fans, in the form of cheers, yells, acclamation and loud noise. The louder the better. There is a perception that the team whose fans are the loudest, will be the winner.

Often, fans and booster clubs use noise making devices, such as bells, whistles, horns, drums, and megaphones. Air horns and electric power horns have been used.

But it is important for the cheers to be readily recognizable to a particular team. Team identification is essential. Each team wants to know which fans are clamoring for them, and which are for the other side. Noise and volume are important; but the noise must be recognizable as support for a specific team. Some fans try to imitate the outcry of their team mascots. But copying mascot outcries has not been practical, due to the difficulties of imitation with sufficient realism and volume to be recognizable. Fans and boosters have a need for a practical, simple and portable means to make loud, coordinated mascot sounds that can be recognized as a show of support for their own team.

The present invention fulfills that need. An object of the present invention is to enable booster fans of an athletic team to simulate a characteristic outcry of mascot sounds.

A further object is to enable fans to simulate such mascot sounds in a coordinated, collective demonstration for maximum effect.

SUMMARY OF THE INVENTION

The present invention is a battery powered, hand held, clamor making device, not requiring vocal support, for creating a great outburst of recognizable, characteristic mascot sounds, directly identifiable with a given sports team.

A read-only-memory circuit is digitally programmed, and connected with a digital-to-analog converter, an amplifier, a speaker, a power supply, and a trigger switch, miniaturized and packaged in a light weight, hand held apparatus, which provides amplification and output of recognizable, characteristic sounds of a particular mascot. The read-only-memory is preprogrammed with digital data depicting the selected sounds of a team mascot.

With this device, a fan or member of a booster group is able simply to actuate the trigger switch and create a noise like his team mascot. With this in the hands of a group of booster fans, the group is enabled to sound like a multitude of mascots of their own team, and will be readily recognizable by everyone in the stands.

The simplicity of design of this device, eliminating bulky audio input, playback circuitry and other nonessential components, permits the compact, light weight and portable form of this device, operable with one hand and without vocal support, which minimizes costs so as to encourage mass usage in coordinated, collective demonstrations by large groups of boosters for maximum effect.

BRIEF DESCRIPTION OF THE DRAWINGS

A more complete understanding of the invention may be had by reference to the following Detailed Description when taken in conjunction with the accompanying Drawings, wherein:

FIG. 4 is a schematic diagram of the functional components of this device, showing their schematic arrangement, and electrical connections; in this FIG. 4 embodiment, the device as shown here contains the mascot sounds of only one given mascot; and FIG. 5 is a schematic diagram of an alternate embodiment, showing the schematic arrangement and electrical connection of the functional components, in which this alternate embodiment contains, selectively, the separate mascot sounds of three different mascots, each of which can be alternately chosen by the operator, by manually actuating a selector toggle switch.

DETAILED DESCRIPTION OF THE INVENTION

Figure 1:
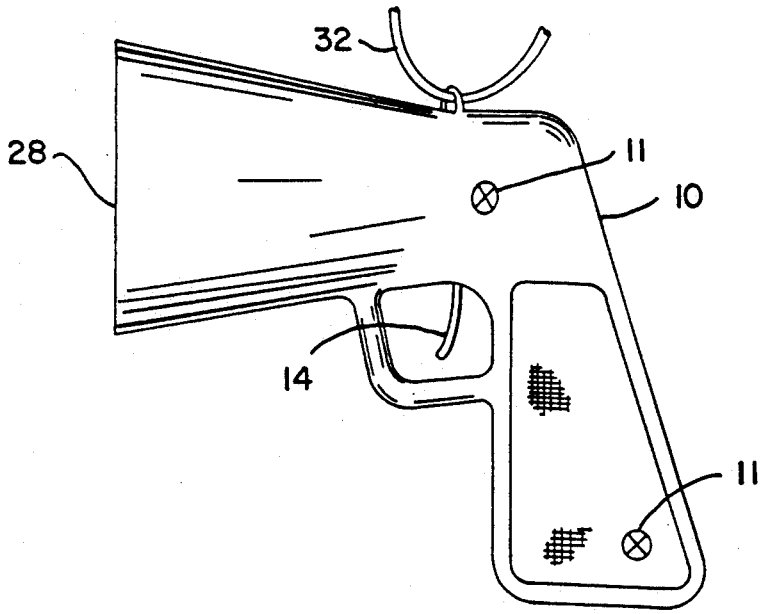
FIG. 1 is an exterior, side view of a preferred embodiment of this invention in a pistol grip shape.

Referring now to the Drawings, wherein like reference characters designate like or corresponding parts throughout several views, FIG. 1 shows an external, side view of the invention in a typical configuration, with optional lanyard 32, for carrying the device when not being hand held.

Figure 2:
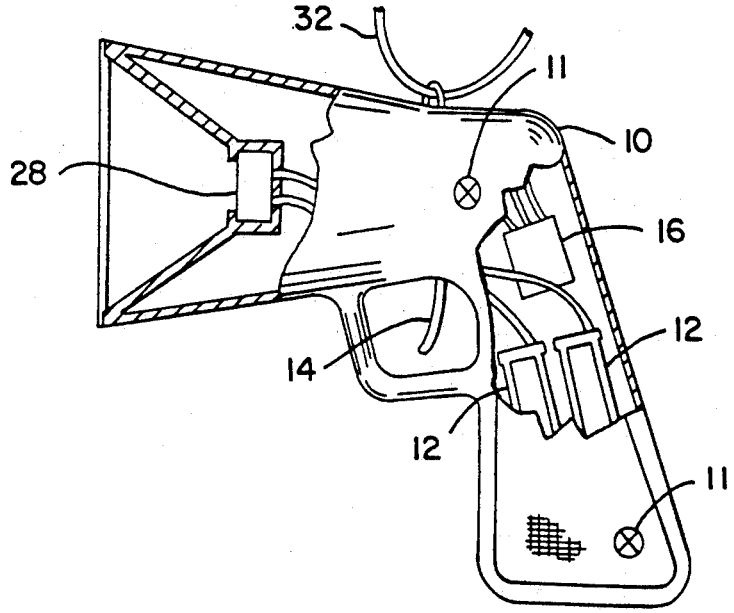
FIG. 2 is a cutaway, side view of the pistol grip embodiment, showing within the cutaway area, the typical interior arrangement of components located within the pistol grip shaped container.
Figure 3:
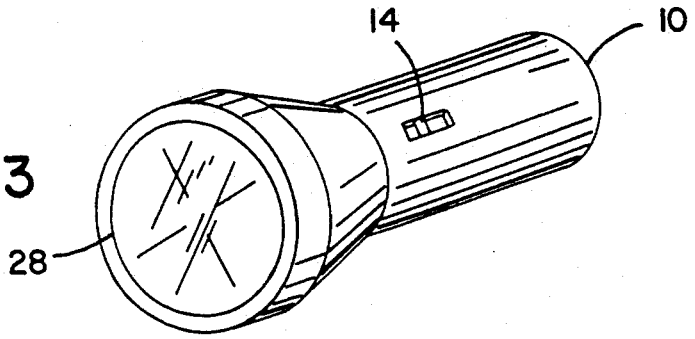
FIG. 3 shows a perspective, external view of an alternate embodiment in the general exterior shape of a flashlight.

The external shape is shown in FIG. 1 in the preferred embodiment as a general pistol grip configuration; but would not be essentially confined to this particular shape and arrangement. The exterior will ideally be arranged, for example as shown in FIG. 2, to accommodate and house the essential electrical components, as required in FIG. 4, in the most convenient manner while minimizing size and weight, and for optimum ease of handling and operation in one hand. External shape is a function of packaging, enhanced eye appeal and marketing, it being recognized that one marketing approach may favor the external shape of a flashlight as shown in FIG. 3; while another plan might prefer the pistol grip shape as shown in FIG. 1; and other external shapes are equally possible and practical with this invention as described herein, with equal results functionally. In both FIG. 1 and 2, the container 10 consists of two symmetrical but opposite halves, with the two halves being held together by two retaining screws 11, to form the closed container 10.

FIG. 2 is a cutaway, side view of the pistol grip embodiment, showing within the cutaway area, a typical interior arrangement of components located within the pistol grip shaped container 10. But FIG. 2 is only one of the typical physical arrangements of the components within the shape of the container 10. As explained above, the exterior shape is a function of the marketing plan, with the requirement that it must house and contain the essential components of FIG. 4; and likewise, the physical arrangement and location of the components can be adjusted to accommodate the exterior shape and will provide equal results under this invention, so long as the components are electrically connected as shown in the schematic diagrams of FIG. 4 and alternately of FIG. 5.

FIG. 4 shows the schematic arrangement of the power supply 12, which in this embodiment is a six volt battery, as connected to the trigger switch 14 for actuation of electric power, which is in turn connected to the read-only-memory (ROM) integrated circuit means 16.

In FIG. 4, the trigger switch 14 is shown as two simultaneously actuated and parallel electric switches, 14A and 14B, with switch 14A providing electricity to the digital memory 18, and with switch 14B providing electricity to the read-only-memory circuit means 16; and both are simultaneously actuated in parallel by operation of the single trigger switch 14. Likewise, in FIG. 5, both switch 14A and 14B are simultaneously actuated in parallel by operation of the single trigger switch 14.

The ROM circuit means 16 may be a conventional integrated chip circuit assembly for this purpose, and may equally be other equivalent, conventional circuit assembly, of the type well known to persons of ordinary skills in the art of electronic circuits. The ROM circuit means 16 must contain, in turn, a digital memory 18, an address counter 20, an oscillator 22, and a digital-to-analog converter means 24, with the combination of said contents comprising the ROM circuit means 16. The output of the ROM circuit means 16 is connected to the amplifier means 26, which is shown here as a transistorized amplifier, and which is, in turn, connected to the speaker converting means 28, which is grounded 30, within the housing 10 for return of the electric circuit to the battery 12.

In operation, the ROM circuit means 16 provides programmed storage for, and selective read out of, characteristic mascot sounds of a given sports team. The ROM circuit 16 contains a digital memory 18, which in turn contains binary bits stored at each address within the memory 18, thus representing time slots. The sum of the time slots digitally depicts the selected mascot sounds. ROM circuit 16 contains an address counter 20 for sequentially reading the programmed digital output from said digital memory 18. ROM circuit 16 further contains an oscillator 22 for driving and incrementing said address counter 20. ROM circuit 16 further contains digital-to-analog converter means 24 for converting said digital output into an analog voltage signal.

The analog voltage signal output from the ROM circuit 16 is connected to amplifier means 26, for amplifying said analog voltage signal to a predetermined range for driving the speaker converter 28. The speaker converter 28 is an electromagnetically driven voice coil, diaphragm and cone as shown at 28, which converts the amplified analog voltage signals into humanly recognizable, audible mascot sounds which are an object of this device in simulation of the team mascot.

During manufacture, the digital memory 18, of the ROM circuit means 16, must be programmed to match the sounds of the mascot of the particular sports team for whose fans this device will be supplied. That is to say, the digital memory 18 must be programmed to contain the appropriate binary bits of said mascot sounds at each address time slot. The sum of these time slots represents and depicts the typical mascot sounds of the preselected mascot when decoded by the digital-to-analog converter 24.

For example, if the selected team mascot is a bear; then the digital memory 18 of each of these clamor making devices is preprogrammed to contain a digital representation of the growl of a bear.

Typically, for the sake of economy, a device per this invention will be programmed to contain the outcry of only the mascot of one particular team as shown in the FIG. 4 embodiment. However it is within the purview of this invention that the ROM 16 may be manufactured to contain, selectably, two or more mascot sounds, as shown in the FIG. 5 embodiment which provides selectively three different mascot sounds, at the option of the operator. In such alternate embodiment, the ROM 16 will contain two or more redundant parallel memories 18, each containing the message of a different mascot sound, and will be equipped with one or more selector toggle switches 15, by which the operator may select one of a choice of mascots, at his option. In other words, if there would be a market for such a device, this invention can be manufactured as shown in FIG. 5 with one or more selector switches 15, and with three parallel memory circuits 18, with each separately containing the sound, for example, of a bear, and optionally of a cougar, and optionally of a cowboy, or any other combination of mascots, to be selected by at option of the operator fan.

In operation, a device of this manufacture, with programmed mascot sound will be sold, provided or otherwise supplied to each member of the booster fan club, along with instructions for operation. At the game, upon signal from the cheer leader, each fan will activate his clamor making device, and the air would be filled with the sounds of a multitude of team mascots.

Although a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A hand held clamor for simulating and amplifying the sounds associated with an animal mascot for a sports team, comprising:

a. a housing small enough to be hand held, said housing being in the shape of a gun having a handle portion adapted to be grasped by the palm of the hand and a cone shaped portion integral with said handle portion substantially perpendicular to said handle portion;

b. an electric battery contained within said housing;

c. a manually operated trigger switch for selective flow of electric power from said battery, said trigger switch being operable when said housing is held in the hand by grasping said handle portion, said trigger switch positioned substantially parallel to said handle portion and connected to said electric battery, said trigger switch having an actuated switch and a parallel electric switch, said actuated and said parallel switches simultaneously actuated in parallel by a single stroke of said trigger switch;

d. a read-only memory circuit means providing programmed storage and selectively reading characteristic mascot sound data of a given sports team, said read-only memory circuit means having a digital memory for storing at least one said characteristic mascot sound data, an address counter, an oscillator, a digital to analog converter means providing analog output, said parallel switch providing electricity to said digital memory, said actuated switch providing electricity to said read-only memory circuit means, said digital memory having binary data stored at each of a plurality of addresses within the digital memory representing sequential slots providing a digital memory output, the sum of said time slots digitally providing said characteristic mascot sound data, said address counter selectively obtaining said digital memory output from said digital memory when activated from said trigger;

e. an amplifying analog voltage means for assimilating a megaphone that amplifies sound, said amplifying analog voltage means connected to said analog output, and having an amplified analog voltage output;

f. an electromagnetic convertor means, said electromagnetic converter means amplifying said amplified analog voltage output into recognizable audible sounds in simulation of said mascot, said electromagnetic convertor means positioned in said cone shaped portion of said housing for assisting amplification of said audible sounds and for directing said audible sounds outwardly from said housing when said housing is held in the hand by grasping said hand portion thereof, said electromagnetic convertor means connected to said amplifying analog voltage means and within said housing, said electromagnetic convertor means having a speaker converter, said speaker converter having an electromagnetically driven voice coil, a diaphragm and a cone; and g. said battery, said trigger switch, said read-only memory circuit means, said amplifying analog voltage means, and said electromagnetic convertor means being electrically connected, modularized and contained within said hand held housing for manual operation by means of said trigger switch.

2. A hand held clamor for simulating and amplifying the sounds associated with an animal mascot for a sports team, comprising:

a. a housing small enough to be hand held, said housing being in the shape of a flashlight having a handle portion adapted to be grasped by the palm of the hand and a cone shaped portion outwardly extending from said handle portion and substantially linear with said handle portion;

b. an electric battery contained within said housing;

c. a manually operated trigger switch for selective flow of electric power from said battery, said trigger switch being operable when said housing is held in the hand by grasping said handle portion, said trigger switch positioned substantially parallel to said handle portion and connected to said electric battery, said trigger switch having an actuated switch and a parallel electric switch, said actuated and said parallel switches simultaneously actuated in parallel by a single stroke of said trigger switch;

d. a read-only memory circuit means providing programmed storage and selectively reading characteristic mascot sound data of a given sports team, said read-only memory circuit means having a digital memory for storing at least one said characteristic mascot sound data, an address counter, an oscillator, a digital to analog converter means providing analog output, said parallel switch providing electricity to said digital memory, said actuated switch providing electricity to said read-only memory circuit means, said digital memory having binary data stored at each of a plurality of addresses within the digital memory representing sequential slots providing a digital memory output, the sum of said time slots digitally providing said characteristic mascot sound data, said address counter selectively obtaining said digital memory output from said digital memory when activated from said trigger;

e. an amplifying analog voltage means for assimilating a megaphone that amplifies sound, said amplifying analog voltage means connected to said analog output, and having an amplified analog voltage output;

f. an electromagnetic convertor means, said electromagnetic convertor means amplifying said amplified analog voltage output into recognizable audible sounds in simulation of said mascot, said electromagnetic convertor means positioned in said cone shaped portion of said housing for assisting amplification of said audible sounds and for directing said audible sounds outwardly from said housing when said housing is held in the hand by grasping said hand portion thereof, said electromagnetic convertor means connected to said amplifying analog voltage means and within said housing, said electromagnetic convertor means having a speaker convertor, said speaker converter having an electromagnetically driven voice coil, a diaphragm and a cone; and g. said battery, said trigger switch, said read-only memory circuit means, said amplifying analog voltage means, and said electromagnetic convertor means being electrically connected, modularized and contained within said hand held housing for manual operation by means of said trigger switch.

* * * * *